US008220193B1

(12) United States Patent
Lynch

(10) Patent No.: US 8,220,193 B1
(45) Date of Patent: Jul. 17, 2012

(54) METHOD AND APPARATUS FOR ADJUSTABLE TRIGGER ASSEMBLIES FOR FIREARMS

(75) Inventor: Thomas Lynch, Wallingford, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 17 days.

(21) Appl. No.: 12/887,718

(22) Filed: Sep. 22, 2010

(51) Int. Cl.
*F41A 17/82* (2006.01)

(52) U.S. Cl. ..... 42/70.08

(58) Field of Classification Search ..... 42/69.01–70.11
See application file for complete search history.

(56) References Cited

U.S. PATENT DOCUMENTS

| | | | | | |
|---|---|---|---|---|---|
| 698,440 | A | * | 4/1902 | Brown | 42/69.01 |
| 1,285,885 | A | * | 11/1918 | Younger | 42/69.01 |
| 2,249,232 | A | | 7/1941 | Smith | |
| 2,375,381 | A | * | 5/1945 | Pale | 42/69.01 |
| 2,584,299 | A | | 2/1952 | Sefried, II | |
| 3,731,416 | A | | 5/1973 | Semple | |
| 3,747,251 | A | | 7/1973 | Baker | |
| 4,005,540 | A | * | 2/1977 | Robinson | 42/69.01 |
| 4,017,996 | A | | 4/1977 | Liedke | |
| 4,058,924 | A | | 11/1977 | Mullner | |
| 4,449,313 | A | * | 5/1984 | Hackett | 42/69.01 |
| 4,667,429 | A | | 5/1987 | Perazzi | |
| 4,671,005 | A | | 6/1987 | Jewell | |
| 4,691,461 | A | | 9/1987 | Behlert | |
| 4,754,567 | A | * | 7/1988 | Lehfeldt et al. | 42/69.02 |
| 4,908,970 | A | | 3/1990 | Bell | |
| 5,012,604 | A | | 5/1991 | Rogers | |
| 5,025,582 | A | * | 6/1991 | Mote, Sr. | 42/70.06 |
| 5,487,233 | A | | 1/1996 | Jewell | |
| 5,560,134 | A | * | 10/1996 | Van Niekerk et al. | 42/70.06 |
| 6,073,380 | A | | 6/2000 | Hauser et al. | |
| 6,131,324 | A | | 10/2000 | Jewell | |
| 6,164,001 | A | | 12/2000 | Lee | |
| 6,415,539 | B1 | | 7/2002 | Fuchs et al. | |
| 6,553,706 | B1 | | 4/2003 | Gancarz et al. | |
| 6,640,479 | B2 | | 11/2003 | Gühring et al. | |
| 6,681,511 | B1 | | 1/2004 | Huber | |
| 6,705,036 | B2 | | 3/2004 | Orr | |
| 6,772,548 | B1 | | 8/2004 | Power | |
| 6,820,606 | B1 | | 11/2004 | Duffey | |

(Continued)

FOREIGN PATENT DOCUMENTS

| | | |
|---|---|---|
| DE | 2263888 | 7/1973 |

*Primary Examiner* — Troy Chambers
(74) *Attorney, Agent, or Firm* — Holland & Bonzagni, P.C.; Donald S. Holland, Esq.

(57) ABSTRACT

Applicant has disclosed an improved trigger assembly for firearms, and a related method, to avoid premature firing after an unintentional trigger rotation, especially where light trigger pulls have previously been set. In the preferred embodiment, Applicant's trigger assembly has two triggers: a slotted primary trigger and a secondary trigger which can pivot into the slot. During an intentional trigger pull, the shooter's finger initially pushes against the secondary trigger until it pivots and nestles within the primary trigger's slot. Continued pulling on both the secondary and primary triggers causes a hammer to rotate off a sear, thereby allowing the firearm to discharge. In an unintentional trigger rotation, where the secondary trigger is not pulled back enough to nestle within the primary trigger's slot: an upper portion of the secondary trigger (unseen within the housing) constrains a protrusion on a spring-biased mainspring guide. This blocks movement of the mainspring guide and prevents the hammer from rotating sufficiently for discharge.

9 Claims, 6 Drawing Sheets

U.S. PATENT DOCUMENTS

| | | | | |
|---|---|---|---|---|
| 6,843,013 | B2 * | 1/2005 | Cutini et al. | 42/70.06 |
| 6,978,568 | B2 | 12/2005 | Jewell | |
| 7,047,685 | B2 | 5/2006 | Diaz et al. | |
| 7,051,467 | B1 | 5/2006 | Huber | |
| 7,165,352 | B2 | 1/2007 | Langlotz | |
| 7,188,561 | B1 | 3/2007 | Kelbly | |
| 7,243,452 | B2 | 7/2007 | Zeh | |
| 7,331,136 | B2 | 2/2008 | Geissele | |
| 7,398,723 | B1 | 7/2008 | Blakley | |
| D597,626 | S * | 8/2009 | Krieger | D22/108 |
| 2007/0006507 | A1 * | 1/2007 | Nehrt | 42/69.01 |
| 2010/0024273 | A1 | 2/2010 | Duperry et al. | |

* cited by examiner

METHOD AND APPARATUS FOR ADJUSTABLE TRIGGER ASSEMBLIES FOR FIREARMS

FIELD OF INVENTION

This invention relates generally to firearms. More specifically, it relates to trigger assemblies for firearms.

BACKGROUND OF INVENTION

Trigger assemblies in firearms are often adjusted for both hunting and competitive shooting. Lighter trigger pulls (i.e., trigger pull forces for discharges) may be preferred for competition or hunting to ensure quicker or more accurate shots. Shooters often want to adjust the trigger force to their own preference, depending upon the particular application.

Some long guns, such as rifles, have come equipped for years with set screws for trigger adjustment. Turning a set screw clockwise typically increases the compression of a coil spring, which rests against a trigger stem inside a receiver housing. That creates a heavier trigger pull. Letting up on the spring, by turning the screw counterclockwise, lightens the'trigger pull.

Sometimes, shooters make unauthorized and non-advisable modifications in order to lessen trigger pull force. Certain modifications can create very light trigger pull forces, but can also cause potential safety problems. Firearm manufacturers neither recommend nor sanction this approach.

Many different types of adjustable trigger assemblies have been patented, such as: U.S. Pat. No. 2,249,232 to Smith; U.S. Pat. No. 4,667,429 to Perazzi; U.S. Pat. No. 4,671,005 to Jewell; U.S. Pat. No. 4,691,461 to Behlert; U.S. Pat. No. 4,908,970 to Bell; U.S. Pat. No. 5,012,604 to Rogers; U.S. Pat. No. 5,487,233 to Jewell; U.S. Pat. No. 6,131,324 to Jewell; U.S. Pat. No. 6,164,001 to Lee; U.S. Pat. No. 6,553,706 to Gancarz et al.; U.S. Pat. No. 6,978,568 to Jewell; U.S. Pat. No. 7,047,685 to Diaz et al.; and U.S. Pat. No. 7,165,352 to Langlotz. Several of these assemblies have many small interacting parts. Small parts are difficult to manufacture properly, which can lead to jamming or delayed functioning.

Accordingly, it is a principal object of the present invention to provide an improved trigger assembly for firearms to avoid discharging the firearm after an unintentional trigger rotation, where light trigger pulls have previously been set.

It is another principal object of the present invention to provide a related method for avoiding discharge of a firearm after an unintentional trigger rotation, where light trigger pulls have previously been set.

It is another general object to provide an adjustable trigger assembly which has fewer parts and is easier to manufacture.

It is a more specific object to provide an adjustable trigger assembly, commensurate with the above-listed objects, which is durable to use.

SUMMARY OF INVENTION

Applicant has disclosed an improved trigger assembly, and a related method, for avoiding unintended discharge in firearms such as shotguns and rifles. In the preferred embodiment, Applicant's trigger assembly comprises: a trigger housing; a modified standard trigger having a central elongated slot or throughbore; a second trigger pivotally mounted within the slot; and a mainspring guide pivotally connected to a hammer; wherein the bottom of the guide has a canted protrusion, with an upturned catch, designed to interact with the second trigger.

During a desired trigger pull, the shooter pulls back on both the first and second triggers. Initially, the second trigger rotates and nestles into the first trigger's slot, until the front faces of both trigger blades are flush. Continued pulling trips the sear off a retaining notch to enable the hammer to rotate or "fall" and discharge the weapon.

If instead the first trigger is jostled accidentally, the catch (and protrusion) are blocked by an upper portion of the second trigger. This prevents the hammer from fully rotating and avoids the discharge. Nothing is foolproof: for example, if both the first trigger and second trigger are jostled together, the firearm may discharge as though an intentional trigger pull has occurred.

In its broadest sense, Applicant's related method can be thought of as: avoiding an unintended discharge of a firearm, upon an unintentional jostling of a first trigger, by requiring both the first trigger and a second trigger, nestled within a longitudinal slot of the first trigger, to be pulled back simultaneously before a complete trigger rotation can occur.

BRIEF DESCRIPTION OF DRAWINGS

The above and other objects will become more readily apparent when the following description is read in conjunction with the accompanying drawings, in which.

DETAILED DESCRIPTION OF PREFERRED EMBODIMENT

Figure 2:
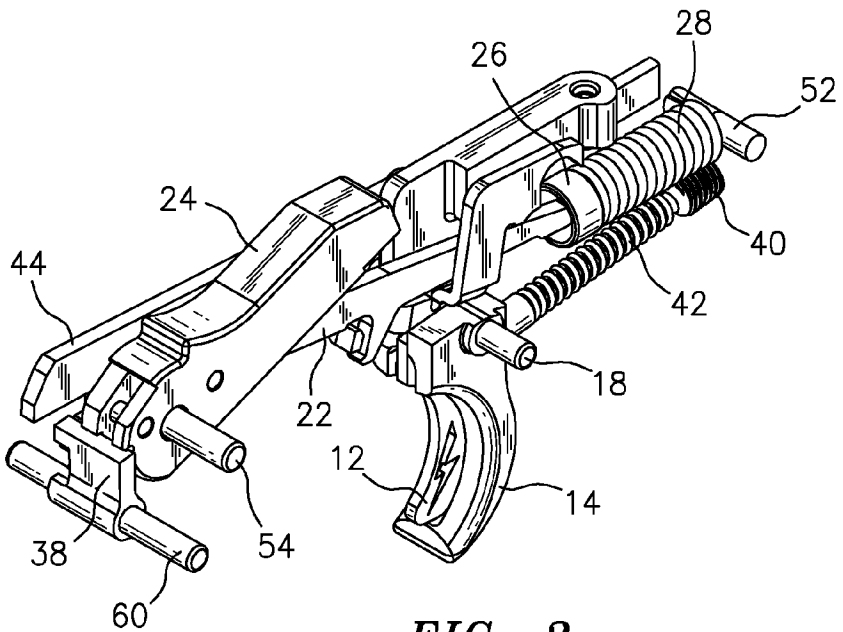
FIG. 2 depicts the preferred trigger assembly of FIG. 1 with portions (e.g., an outer housing) removed to illustrate its main components.
Figure 1:
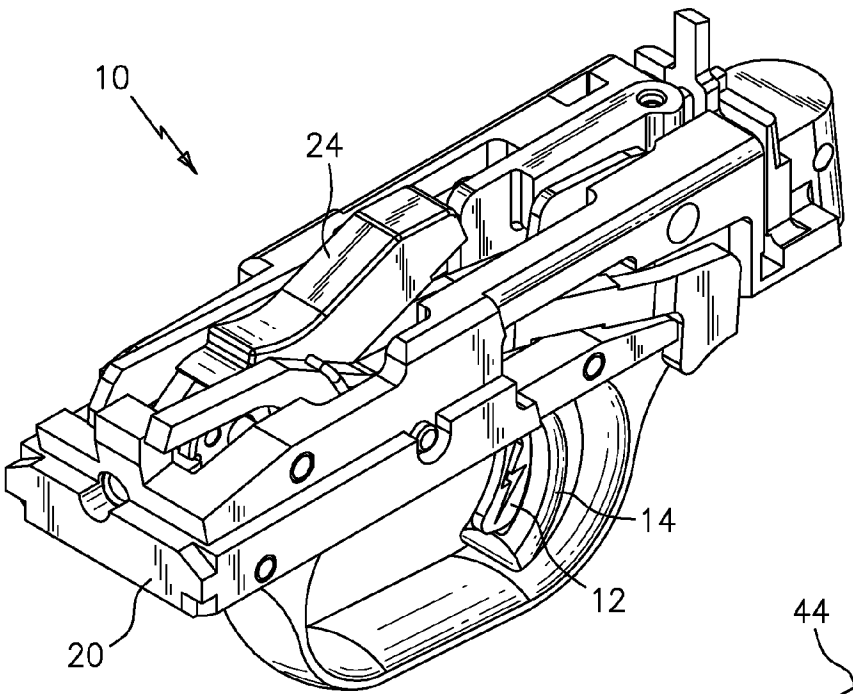
FIG. 1 illustrates a preferred embodiment of an adjustable trigger assembly, constructed in accordance with the present invention, wherein the trigger assembly is in an "at rest" condition.
Figure 3:
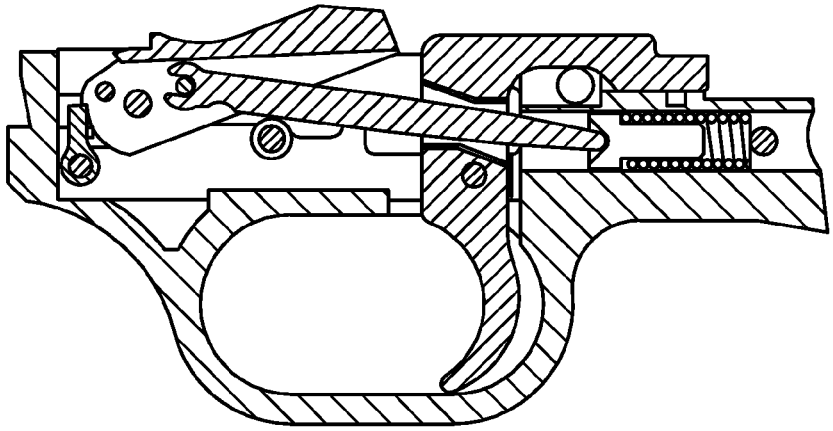
FIG. 3 (PRIOR ART)
FIG. 3, labeled "Prior Art", depicts a cross-sectional view of a standard trigger assembly.
Figure 4:
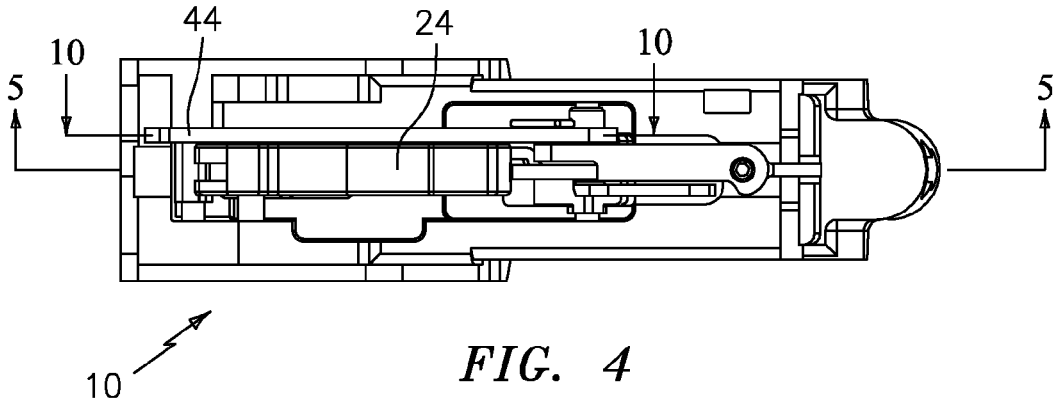
FIG. 4 is a top plan view of Applicant's preferred trigger assembly of FIG. 1.

FIG. 3, labeled "Prior Art", depicts a standard trigger assembly used for years by O.F. Mossberg & Sons, Inc. It includes, among other things, a trigger housing, single trigger, mainspring guide, mainspring, hammer, sear, lock lever, (not shown), disconnector (not shown) and trigger return spring (not shown). Upon rotating the trigger, the disconnector shifts to rotate the sear off a notch in the hammer. This prompts a discharge.

FIGS. 1, 2, 4, 5, 5A, 6, 6A, 7, 7A, 8, 8A, 9, 10, 10A illustrate Applicant's preferred embodiment of an adjustable trigger assembly, generally designated by reference numeral 10, for a long gun, such as a shotgun (not shown).

As shown, a preferred second or secondary trigger 12 is housed within an elongated central slot 13 or throughbore in a first or primary trigger 14, but the second trigger 12 is pivoted independently of the first trigger 14. Both triggers 12, 14 pivot upon the same trigger pin 18, supported by a trigger assembly housing 20. Alternatively, both triggers could be supported on non-coaxial pins (not shown) such as the pins depicted in U.S. Patent Application Publication No. 2010/0024273, published Feb. 4, 2010.

Trigger pin 18 (see FIG. 9) extends through trigger housing 20 (see FIGS. 5, 6, 7, 8, 9, 10). Inside that housing, a mainspring guide 22 is pivotally connected to a hammer 24 and is designed to push against a mainspring plunger 26 and associated mainspring 28 (see FIGS. 5, 6, 7, 9). A canted protrusion or leg 30 extends downwardly from the guide 22, as viewed in the drawings, at a slight angle.

Figure 5:
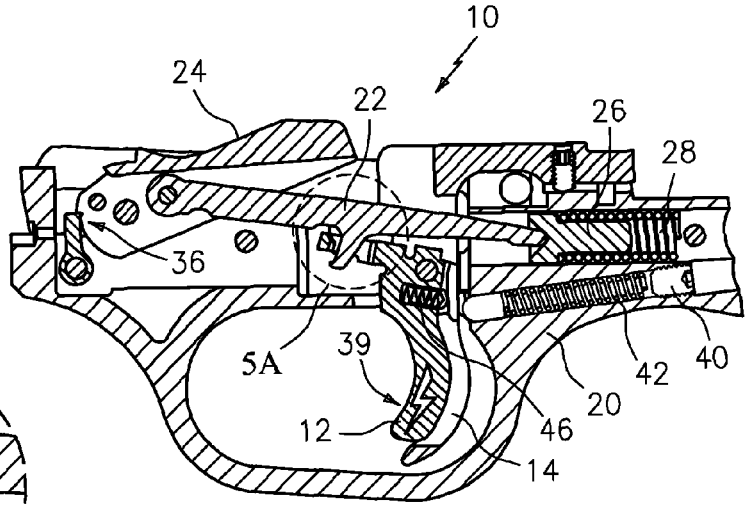
FIG. 5 is a cross-sectional view taken along sight line 5-5 of FIG. 4.
Figure 5A:
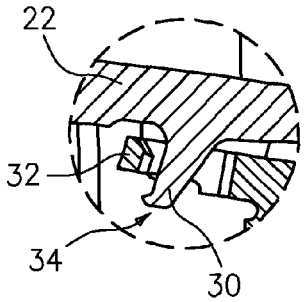
FIG. 5A is an enlarged view of an encircled area in FIG. 5.

As shown in FIG. 5A, the canted protrusion 30 is retained, or captured, within a generally C-shaped horizontal extension 32 of the second trigger 12, when the hammer 24 is set in a cocked or ready position. A distal end of canted protrusion 30 is "upturned" and forms a generally horizontal catch 34.

In Applicant's preferred embodiment, the hammer 24 has a retainer or sear notch 36 (here, a ledge) which rests upon atop a pivotable sear 38, when the firearm is at rest. The mainspring 28 is under compression, or depressed by the mainspring guide 22 acting against plunger 26.

Figure 7:
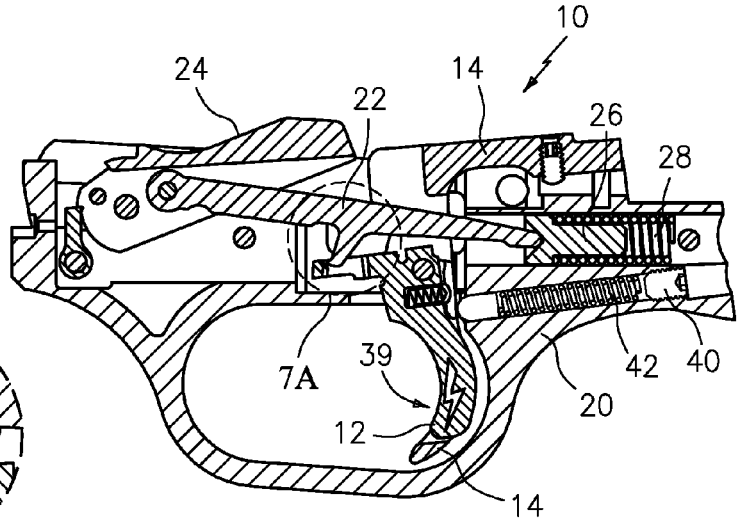
FIG. 7 illustrates Applicant's preferred trigger assembly after an intentional trigger rotation in which the second trigger has nestled within a slot of the first trigger to allow for a normal or full rotation of the two triggers.
Figure 7A:
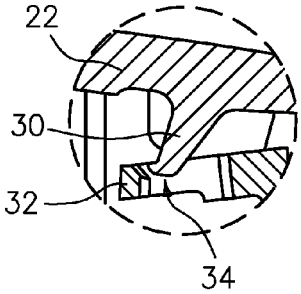
FIG. 7A is an enlarged view of an encircled area in FIG. 7.
Figure 8:
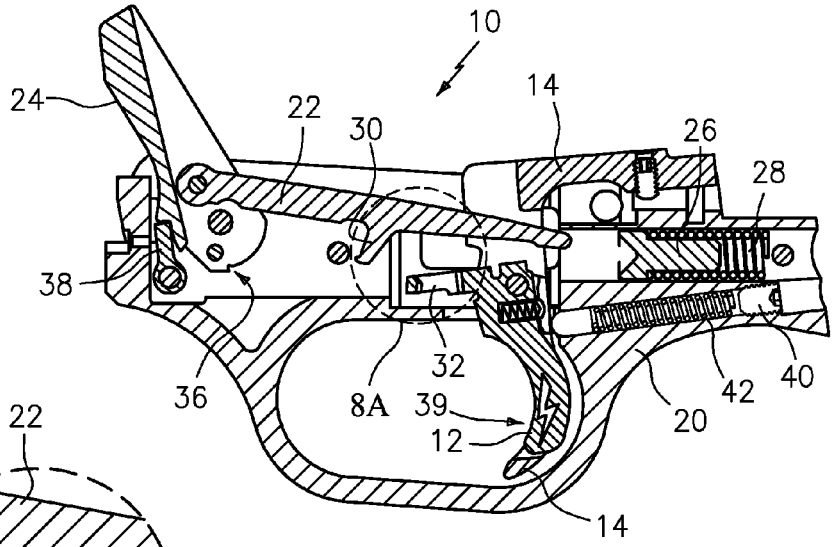
FIG. 8 illustrates Applicant's trigger assembly at discharge.

During a normal, intentional trigger pull by a shooter, the exposed blade 39 of the second trigger 12 is depressed by the shooter's trigger finger (not shown) until that blade is flush with the face of the first trigger 14 (see FIGS. 7, 8). At that point, the blade 39 has nestled within the elongated slot 13 located, preferably centrally, in the first trigger 14. Increasing pressure upon the triggers 12, 14 completes their rotation and causes the firearm to fire or discharge.

A standard disconnector 44 (shown in FIGS. 4, 9 and 10) is pivotally attached to the first trigger 14. During the joint trigger rotation, the disconnector 44 pushes against an integral protrusion 45 on sear 38 (see FIG. 10A), thereby pushing the sear forward and out from under the sear notch 36 in the hammer 24. Note that protrusion 45 extends beyond the hammer, when the parts of Applicants' trigger assembly 10 are assembled.

FIGS. 7, 7A, 8, 8A best show the interaction of the protrusion 30 (and catch 34) with C-shaped extension 32, as the triggers 12, 14 are being pulled. Upon the triggers being rotated fully, the protrusion 30 leaves the confines of C-shaped extension 32 (see FIGS. 8, 8A). This frees the mainspring guide 22, whereupon the depressed spring 28 releases and pushes the guide to the left, as viewed in FIG. 8. When the guide 22 is not constrained by the C-shaped extension 32, the hammer 24 is free to make a full rotation, thus striking a standard firing pin (not shown) and discharging the shotgun.

Figure 8A:
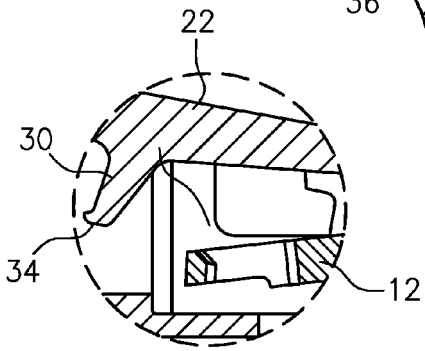
FIG. 8A is an enlarged view of an encircled area in FIG. 8.

FIGS. 8, 8A show the trigger assembly 10 in an "at rest" position, after the discharge.

Figure 6:
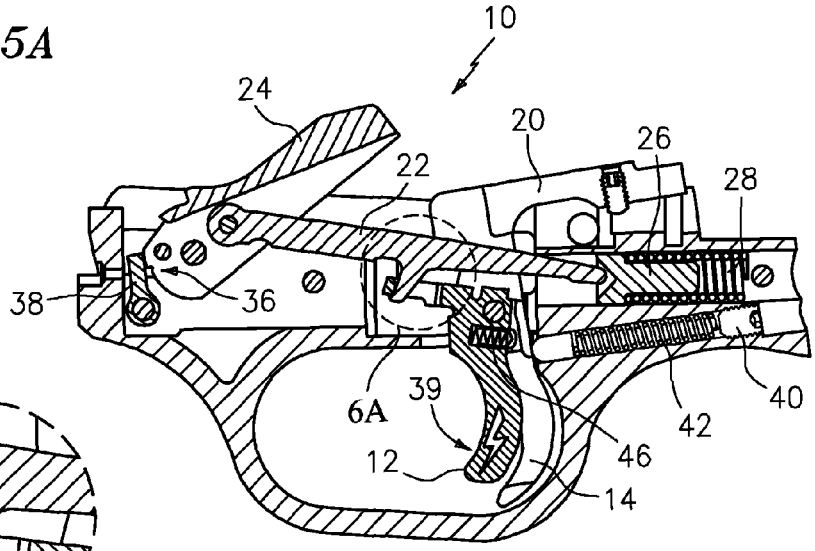
FIG. 6 illustrates the preferred trigger assembly after an unintentional rotation of the first trigger, with Applicant's second trigger blocking a discharge.
Figure 6A:
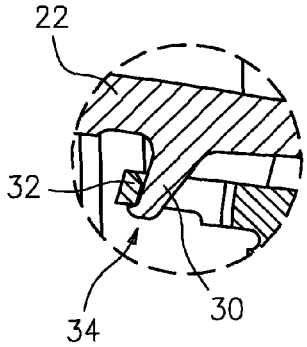
FIG. 6A is an enlarged view of an encircled area in FIG. 6.

In the case of an unintentional rotation of the first trigger 14, the front face of protrusion 30 nestles against the inner left face of the second trigger's C-shaped extension 32 (see FIGS. 6, 6A). This blocks the mainspring guide 22 from moving and thereby keeps the hammer from moving (i.e., rotating) sufficiently to strike the firing pin. This prevents the discharge of the firearm.

In FIG. 5A, a small gap exists between the bottom edge of the C-shaped extension 32 and the tip of catch 34. While the size of this gap will vary depending on part tolerances, its existence allows the second trigger 12 to bounce/rotate a little and still catch the guide 32 when the firearm is jarred and the hammer 24 is accidentally released off sear 38.

During an accidental release of the hammer 24 (i.e., sear 38 disengages), the protrusion 30 engages the C-shaped extension 32 of the second trigger 12, preventing discharge. When protrusion 30 and the C-shaped extension 32 are engaged, the catch 34 locks out the second trigger 12. That is, if a shooter tries to rotate the second trigger 12, it will rotate only until the bottom edge of the C-shaped section 32 catches on the catch 34 of protrusion 30.

The shooter has to rack/reset the hammer 24 and fire control system, which includes the trigger assembly 10, to the at rest position before the firearm can be fired. During resetting, the hammer 24 is rotated clockwise, pushing the guide 22 to the right against spring 28. The back surface of protrusion 30 pushes on the outer top edge of the C-shaped extension 32, which cams the secondary trigger 14 down (counterclockwise) against a blade spring 46. When protrusion 30 has passed over the C-shaped extension 32, the secondary trigger 14 is rotated clockwise under force of spring 46, moving the C-shaped extension to the at rest position. Forward travel of the guide 22 is once more inhibited. As in standard trigger assemblies, the first trigger 14 is returned to its at rest position by an independent trigger return spring 47 (see FIG. 10) whenever an external force is removed (e.g., finger pressure).

The above-described interlock also avoids a discharge if the blade 39 of the second trigger 12 is depressed slightly (i.e., not enough for full nesting) after an unintentional rotation or just a slight pull of trigger 12.

As shown in FIGS. 5, 6, 7, 8, Applicant's trigger assembly 10 can be used with a standard means for adjusting a trigger pull. By turning a set screw 40 either clockwise or counterclockwise, the compression of a trigger adjustment spring 42 can be modified to adjust the trigger pull of the first trigger 14.

Figure 9:
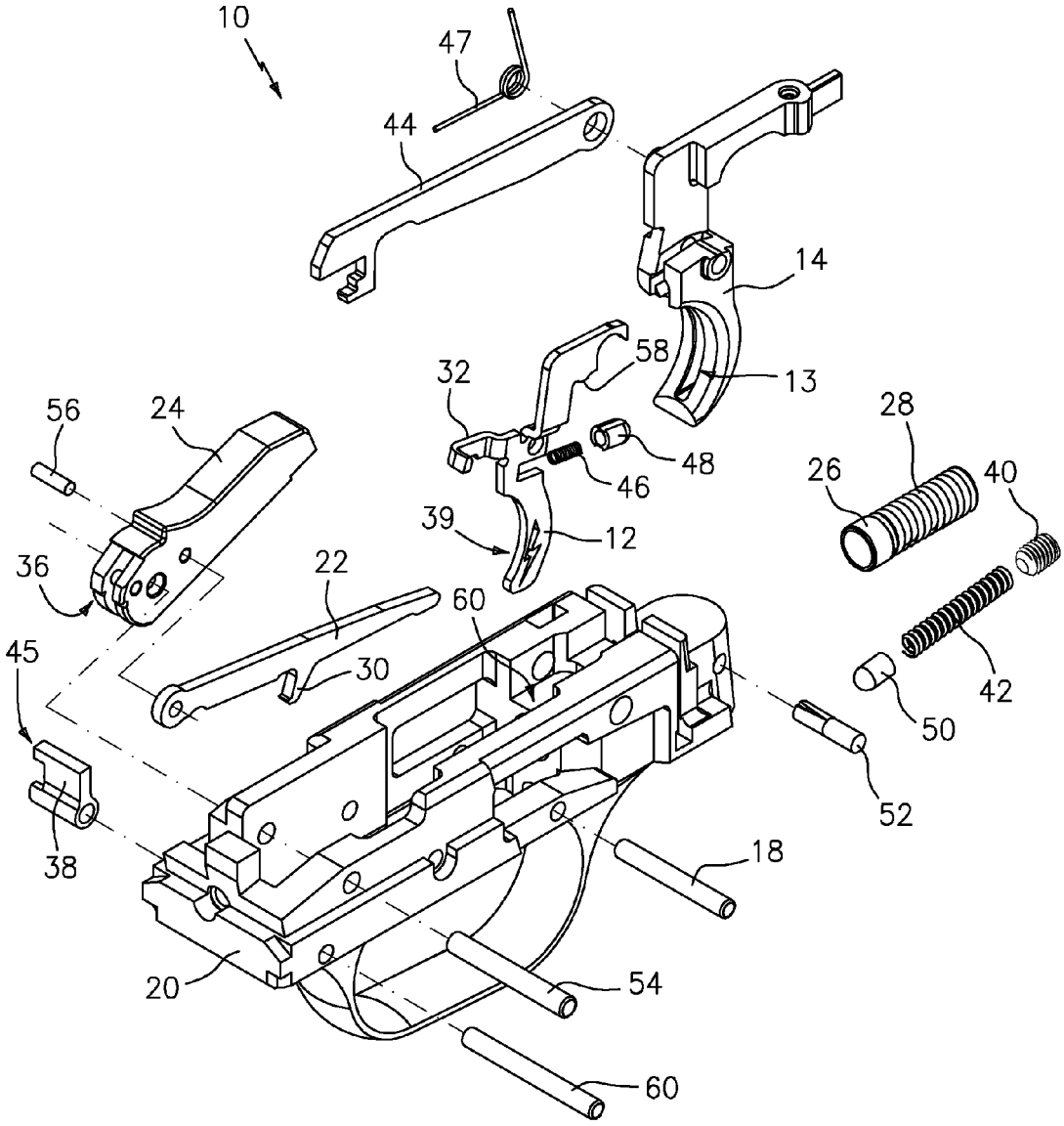
FIG. 9 is an exploded view of the trigger assembly of FIG. 1.
Figure 10:
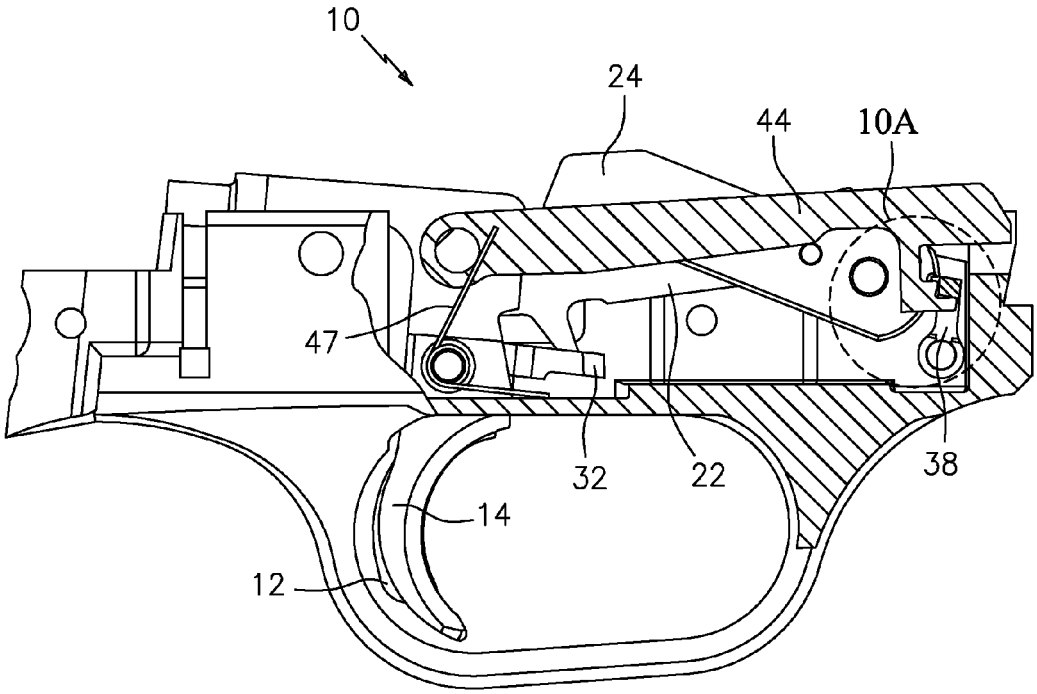
FIG. 10 is a cross-sectional view, taken along sight line 10-10 of FIG. 4, after the second trigger has been partially rotated intentionally.
Figure 10A:
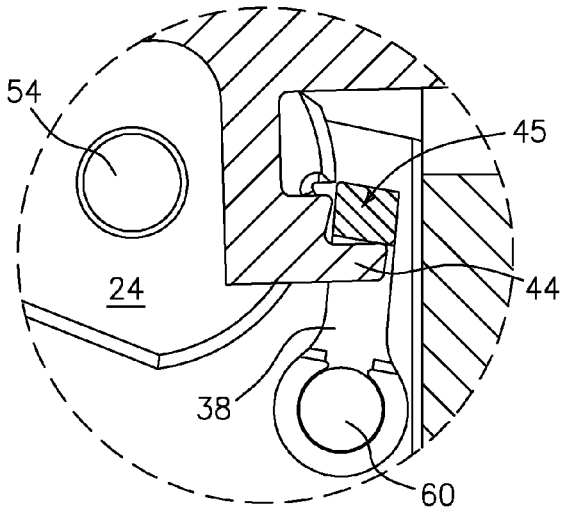
FIG. 10A is an enlarged view of an encircled area in FIG. 10.

FIG. 9 best shows other parts of Applicant's preferred trigger assembly. They are: a blade spring follower 48; an adjustment spring follower 50, a mainspring retaining pin 52, a hammer pin 54, a mainspring guide pin 56, a boss 58 of second trigger 12; and a surface 60 in housing 20.

Boss 58 is designed to stop against surface 60. This times: the blade 39 (of second trigger 12) to the main trigger 14 and times the C-shaped extension 32 to the mainspring guide protrusion 30. It ensures: the blade 39 remains engaged in the trigger slot 13; and the C-shaped extension 32 only contacts the guide 22 when needed to prevent an accidental discharge and when the action is being reset. Boss 58 also prevents the second trigger 12 from rotating when its C-shaped extension 32 engages guide protrusion 30, thus stabilizing the system during an accidental release of the hammer 24.

Correct timing of the second trigger 12 ensures the second trigger will catch the mainspring guide 22 (preventing discharge), even when that trigger bounces or rotates slightly when the firearm is subjected to jarring (e.g., firearm is dropped on a hard surface).

The second trigger 12 is balanced about its pivot axis. This, coupled with its small mass and the forward bias of spring 46, minimizes rotation. Timing does not impact the tendency of the secondary trigger to rotate when the gun is jarred.

Shooters often set their trigger assemblies for a light trigger pull. This invention is designed to avoid premature or unintended discharge at light trigger pull settings. Applicant's double triggers 12, 14, wherein the second trigger (e.g., 12) blocks the forward movement of a mainspring guide to prevent a full hammer rotation, can be thought of as avoidance means for avoiding premature or unintended discharge for light trigger pull settings in firearms.

It should be noted that Applicant's trigger assembly 10 may not be able to prevent all types of unintended or accidental discharges. For example, a heavy unbalanced force applied to the firearm or trigger(s) might override the interlock created by the protrusion 30 inside the C-shaped extension 32; or, if both triggers 12, 14 are jostled together (e.g., a tree branch snags both), that might result in a discharge as though the triggers were intentionally pulled.

Applicant's invention can be thought of as a method comprising the following steps:

a. avoiding unintended discharge of a firearm, upon an unintentional jostling of a first firearm trigger, by a second firearm trigger temporarily and directly blocking movement of a mainspring guide to prevent a hammer from rotating sufficiently for discharge; and
b. discharging the firearm, upon an intentional trigger pull, by:
   i. intentionally pulling and rotating a blade of the second firearm trigger until the blade nestles within an elongated slot of a first firearm trigger; and
   ii. thereafter pulling the triggers together to unblock the mainspring guide assembly and allow the hammer to rotate sufficiently for the firearm to discharge; and
c. wherein the second trigger constrains a protrusion of the mainspring guide during the unintentional jostling.

It should be understood by those skilled in making firearms that obvious structural modifications can be made to the depicted embodiment without departing from the spirit of the invention. For example, the trigger assembly 10 could be adapted for use in rifles. In addition, the trigger assembly could be adapted for use in firearms without adjustable trigger pulls.

I claim:

1. A method comprising:

a. avoiding unintended discharge of a firearm, upon an unintentional jostling of a first firearm trigger, by a second firearm trigger temporarily and directly-blocking a spring-biased mainspring guide from moving, by capturing a protrusion of the guide within an upper extension of the second trigger, thereby keeping the hammer from rotating sufficiently for discharge; and
b. discharging the firearm, upon an intentional trigger pull, by:
   i. intentionally pulling and rotating a blade of the second firearm trigger until the blade nestles within an elongated slot of a first firearm trigger; and
   ii. thereafter pulling and rotating the triggers together to unblock the mainspring guide, thereby allowing the firearm to discharge.

2. A method comprising:

a. avoiding unintended discharge of a firearm, upon an unintentional jostling of a first firearm trigger, by a second firearm trigger temporarily blocking the mainspring guide from moving, by restraining a protrusion of the mainspring guide within the confines of a C-shaped extension of the second trigger, thereby keeping the hammer from rotating sufficiently for discharge; and
b. discharging the firearm, upon an intentional trigger pull, by:
   i. intentionally pulling and rotating a blade of the second firearm trigger until the blade nestles within an elongated slot of a first firearm trigger; and
   ii. thereafter pulling and rotating the triggers together to unblocking the mainspring guide, thereby allowing the firearm to discharge.

3. The method of claim 2 wherein step (a) further comprises: temporarily catching a distal end of the protrusion against an underside of the C-shaped extension, during an unintentional rotation of the first trigger, to prevent rotation of the second trigger.

4. A method comprising:

a. avoiding unintended discharge of a firearm, upon an unintentional jostling of a first firearm trigger, by a second firearm trigger temporarily blocking the mainspring guide from moving, by restraining a protrusion of the mainspring guide within the confines of a C-shaped extension of the second trigger, thereby keeping the hammer from rotating sufficiently for discharge; and
b. discharging the firearm, upon an intentional trigger pull, by:
   i. intentionally pulling and rotating a blade of the second firearm trigger until the blade nestles within an elongated slot of a first firearm trigger; and
   ii. thereafter pulling and rotating both triggers to allow the upper extension to release the protrusion from the confines of the C-shaped extension, thereby unblocking the mainspring guide to enable the hammer to rotate sufficiently for discharge.

5. A method comprising:

a. avoiding unintended discharge of a firearm, upon an unintentional jostling of a first firearm trigger, by a second firearm trigger temporarily and directly blocking movement of a mainspring guide, by constraining a protrusion of the mainspring guide during the unintentional jostling, to prevent a hammer from rotating sufficiently for discharge; and
b. discharging the firearm, upon an intentional trigger pull, by:
   i. intentionally pulling and rotating a blade of the second firearm trigger until the blade nestles within an elongated slot of a first firearm trigger; and
   ii. thereafter pulling the triggers together to unblock the mainspring guide assembly and enable the hammer to rotate off a sear, thereby allowing the firearm to discharge.

6. In an adjustable trigger assembly for a firearm, of the type having a trigger housing, pivotable trigger, mainspring guide assembly, mainspring, and an adjustment screw for adjusting the amount of trigger pull force necessary to discharge the firearm, the improvement comprising:

a. avoidance means for avoiding an unintended discharge caused by an unintentional rotation of a trigger, wherein the avoidance means comprises:
   i. a first trigger having an elongated slot;
   ii. a second trigger pivotable within the slot;
   iii. both the first trigger and the second trigger are pivotally mounted within a housing; and
   iv. the second trigger has an upper portion, designed in size and shape, to engage a canted protrusion of the mainspring guide to block the mainspring guide from moving, within the housing, during an unintentional rotation of the first trigger.

7. The avoidance means of claim 6 wherein the canted protrusion is captured within a C-shaped extension of the second trigger during an unintentional rotation of the first trigger.

8. The avoidance means of claim 7 further comprises a distal end of the protrusion designed in size and shape to catch against an underside of the C-shaped extension, during an unintentional rotation of the first trigger, to prevent rotation of the second trigger.

9. A method comprising the following sequential steps:

a. avoiding unintended discharge of a shotgun, upon an unintentional jostling of a first trigger, by a second trigger temporarily and directly-blocking a spring-biased mainspring guide from moving, by capturing a protrusion of the guide within an upper extension of the second trigger, thereby keeping the hammer from rotating sufficiently for discharge;

b. racking the shotgun to reset the hammer, the first trigger and second trigger; and c. thereafter discharging the firearm, upon an intentional trigger pull, by:

i. intentionally pulling and rotating a blade of the second firearm trigger until the blade nestles within an elongated slot of a first firearm trigger; and ii. thereafter pulling and rotating the triggers together to unblock the mainspring guide, thereby allowing the firearm to discharge.

* * * * *